United States Patent [19]

Akachi et al.

[11] 4,012,894

[45] Mar. 22, 1977

[54] CONDUCTOR TWISTING SYSTEM FOR TWISTING A RUNNING WIRE CONDUCTOR

[75] Inventors: Hisateru Akachi; Hideo Miyajima; Mitsuro Yaguchi, all of Sagamihara, Japan

[73] Assignee: Oki Densen Kabushiki Kaisha, Kawasaki, Japan

[22] Filed: Feb. 21, 1975

[21] Appl. No.: 551,852

[30] Foreign Application Priority Data

Feb. 26, 1974 Japan ..... 49-23130
Sept. 30, 1974 Japan ..... 49-113206

[52] U.S. Cl. ..... 57/34 AT; 57/77.42
[51] Int. Cl.[2] ..... H01B 13/04
[58] Field of Search ..... 57/34 AT, 77.4, 77.42; 264/174

[56] References Cited

UNITED STATES PATENTS

| | | | |
|---|---|---|---|
| 2,943,433 | 7/1960 | Van Dijk | 57/77.42 X |
| 3,078,514 | 2/1963 | Gray | 264/174 |
| 3,172,931 | 3/1965 | Peterson | 264/174 X |
| 3,394,540 | 7/1968 | Bentoo | 57/77.4 X |
| 3,507,108 | 4/1970 | Yoshimura et al. | 57/34 AT |
| 3,659,408 | 5/1972 | Burr | 57/77.42 |
| 3,823,536 | 7/1974 | Vogelsberg et al. | 57/34 AT |

*Primary Examiner*—Richard C. Queisser
*Assistant Examiner*—Charles Gorenstein

[57] ABSTRACT

A conductor twisting system for twisting a running wire conductor comprising at least a set of combined rolls of which the axes are relatively oriented at such an angle that the two component forces resolved from a force of each of rolls acting on the conductor running therebetween are utilized for causing the conductor to rectilinearly travel and rotate in a direction normal to the conductor travel direction, and means for fixing the twist imparted on the running conductor immediately before the twist is untwisted by a twisting stress produced in the running conductor in association with the twist, whereby a high conductor twisting rate is attained with a simple construction.

23 Claims, 22 Drawing Figures

CONDUCTOR TWISTING SYSTEM FOR TWISTING A RUNNING WIRE CONDUCTOR

The present invention relates to a conductor twisting system for twisting a running wire conductor, and more to improvements over the inventions, as described in Japanese Pat. Nos. 104807/'73, 126078/'73, 126079/'73 and 129852/'73. In application, the present invention may be utilized for a system for twisting and rotating a conductor covered with insulating material through an extruding machine, a system for twisting a running conductor alternately in the S and Z directions, a system for stranding a plurality of conductors and rotating the same, a system for stranding a plurality of conductors alternately in the S and Z directions, etc.

When imparting a twist to a point on the running conductor, there occur at the both sides of the point twists opposite in a direction but equal in magnitude, respectively, while at the same time there occur at the same place twisting stresses acting in opposite direction, respectively. With progression of the conductor, the twist and its associated stress both being at one side of the point, shift the other side where they are reduced to zero by opposing such forces existing at the other side. Such untwisting operation of the conductor is also true in the case of so weak twisting stress as to be insufficient for instantaneously untwisting the twisted conductor to its original shape. That is, even in such case, the twist will be completely untwisted until the conductor reaches the take-up reel from the feeding reel through the point of twist application. This untwisting operation is again applicable to the twist of a plurality of conductors. Moreover, this phenomena is found in the running conductor running at a place away from both the feeding and the take-up reels. That is, this untwisting phenomena implies that it is impossible to continuously twist a running wire conductor or a plurality of wire conductors.

This problem was solved by the invention disclosed in Japanese Pat. No. 104807/'73 in which the twist and the rotation (the twisting stress) are separately applied to the running conductor. More specifically, the twist or its associated stress is fixed or released before the twisted conductor is untwisted at the other side of the point of twist application. Thus, the conductor leaving the twisting station is of a twisted wire conductor with a twisting stress (rotation) tending to oppose the stress fixed, so that it travels in rotation by itself if it is free at the end from which it is taken up. The above identified application also discloses a method to manufacture the twisted conductor wire uniformly coating with an insulating material throughout the entire length thereof, by passing through an extruding machine such conductor wire, i.e. the conductor having a fixed twist and a rotation opposing the fixed twist. If the rotation is forcibly impeded downstream of the twisting station, the fixed stress and the rotation are both reduced to zero. The result is that the conductor is returned to its original state. Accordingly, when such rotation preventing operation intermittently repeated, the running conductor takes a form of a successive alternation of a twisted section and a non-twisted section, or a rotational section and a not rotational section. Ultimately, the take-up reel will take up a conductor alternately twisted in the S and the Z directions, as disclosed in Japanese Pat. No. 126078/'73. Thus produced SZ alternately twisted conductor subsequently passes through an extruding machine for covering it with insulating material. The resultant conductor has a uniform thickness of insulating material as a whole. This is disclosed in Japanese Pat. No. 126079/'73. The technical application of this patent application is disclosed in Japanese Pat. No. 129852/'73 of which the invention relates to a system for twisting a plurality of conductors.

In construction, these inventions described above need no use of the revolving bulky bobbin or the complicated traversing scheme. For this reason, the conductor twisting may be carried out at a high rate and with safety and economy. Further, a very great increase of the rotational speed is attained in the manufacture of the SZ alternately twisted conductor or strand. This is because there is eliminated a complicated construction for inversing the twist or the rotation in direction, which is a major defect of the conventional system.

Nevertheless, these inventions above identified still involve some problems to urgently be solved arising from the revolving frame accommodating guide rolls, and stress removing rolls, which is commonly used in the above identified inventions. More specifically, the great centrifugal force developed by a high rate rotation of the revolving frame, encumbers the smooth rotation of the guide rolls, and the stress removing rolls. This results in an excessive extension of fine wire conductors, conductors made of soft material or the like, and damage of fragile coating of the wire conductors. Moreover, when it is used in the system for twisting a plurality of conductors, such revolving frame becomes large in size, although it is small as compared with the conventional system. Moreover, the conductor twisting system of the prior art is complicated in construction with the need of its associated various apparatuses which will be enumerated below: A bulky revolving frame provided therein with guide wheels; and a number of rolls, these revolving normal to the conductor traveling direction; A reduction gear for revolving the revolving frame per se and its associated guide wheels and rolls at a desired speed; A speed change gear for adjusting the pitch of twist of a conductor or a strand; A breaking apparatus and an inverse rotating apparatus for providing a sudden start and a sudden stop with respect to the conductor transmitting operation for manufacturing the SZ alternately twisted conductor or strand; and so forth. Additionally, for driving such large and complicated system at a high accuracy and a high speed, required is a large amount of power consumption.

Accordingly, a main object of the present invention is to provide a conductor twisting system with a high production rate and of simple construction.

Another object of the present invention is to provide a twisting system for twisting a plurality of conductors which is easily controllable in operation and operable at a high speed and of simple and economy construction.

Yet another object of the present invention is to provide a system for manufacturing a SZ alternately twisted conductor which is operable at a high speed and controllable freely and quickly, and of simple construction.

Other object of the present invention is to provide a system for manufacturing a SZ alternately twisted strand which operable at a high speed and controllable freely and quickly, and of simple and a relatively small construction.

In accordance with the present invention, these objects are achieved by a twisting system comprising at least a pair of rolls of which the axes are oriented each other at such an angle as to permit a rectilinear passage therebetween of the conductor in rotation, and means for fixing the twist imparted on the running conductor immediately before said twist is untwisted by a twisting stress produced in the running conductor in association with said twist.

Other objects and features of this invention will be apparent upon a careful consideration of the following description when taken in connection with the accompanying drawings.

Figure 4:
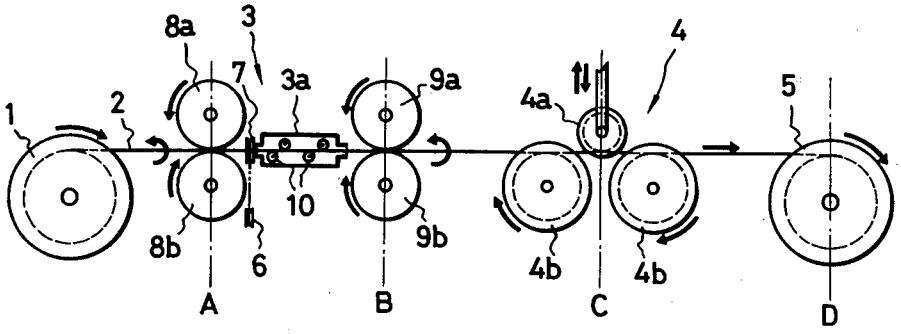
FIG. 4 is a schematic representation of a first embodiment of a conductor twisting system according to the present invention.
Figure 5A:
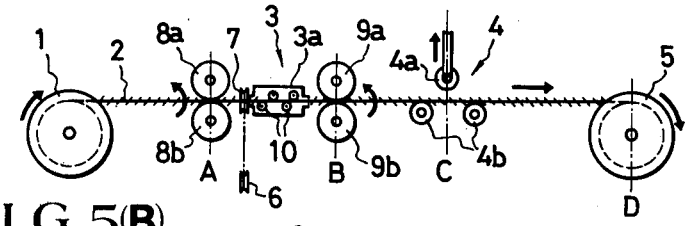
Figure 6:
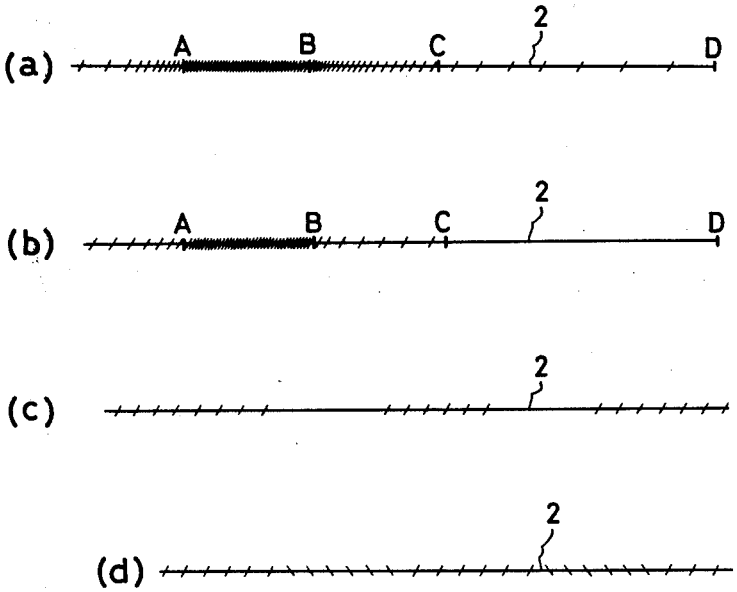
Figure 7:
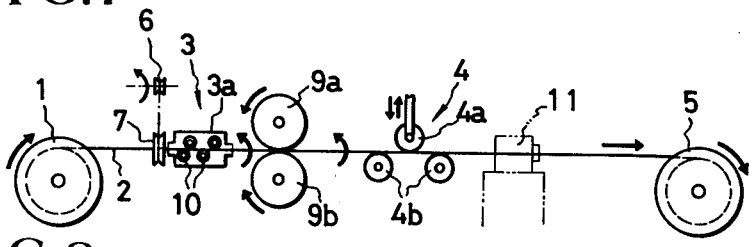
Figure 8:
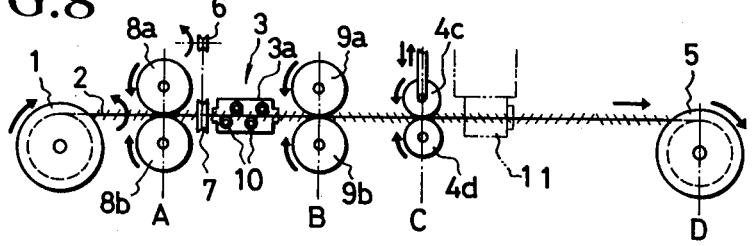
Figure 9:
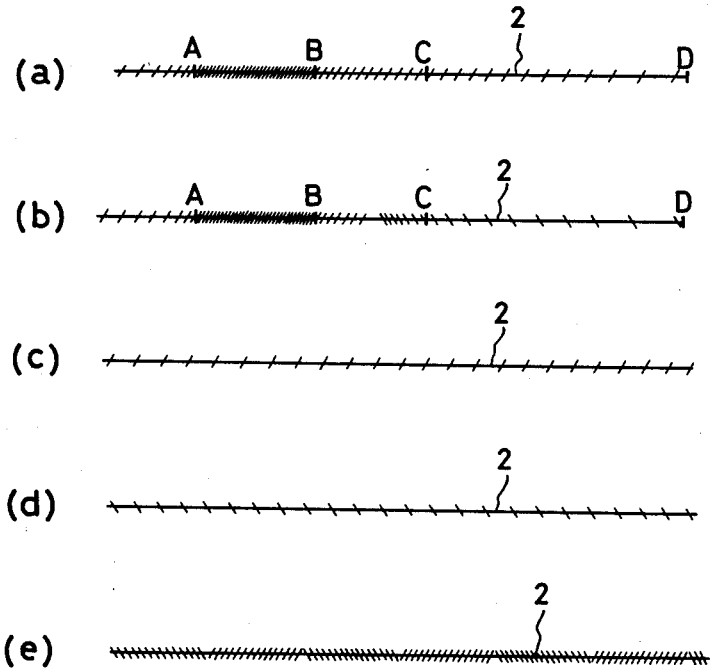
Figure 10:
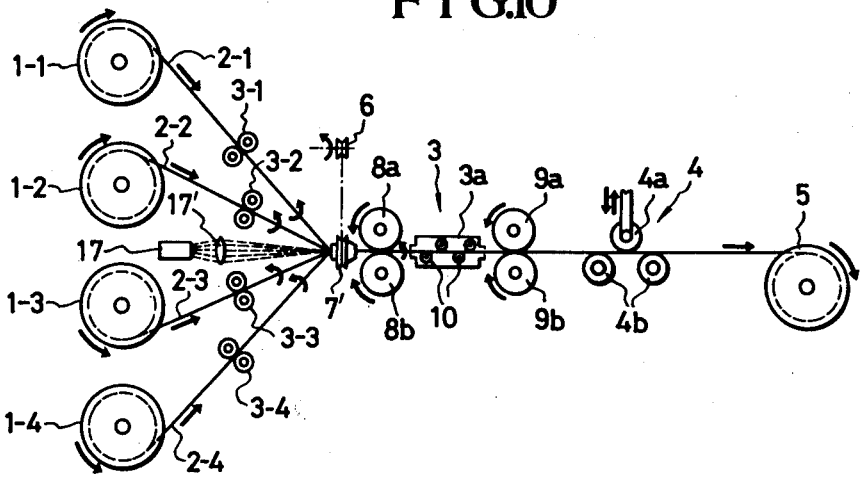
Figure 11:
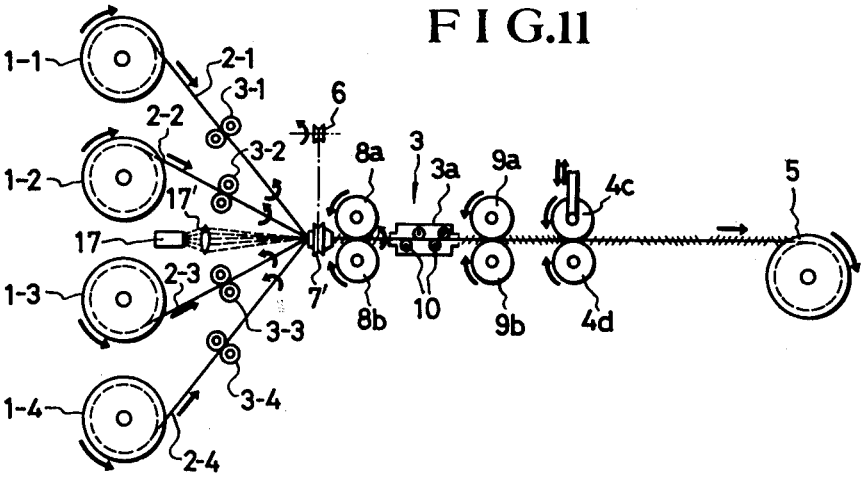
Figure 12:
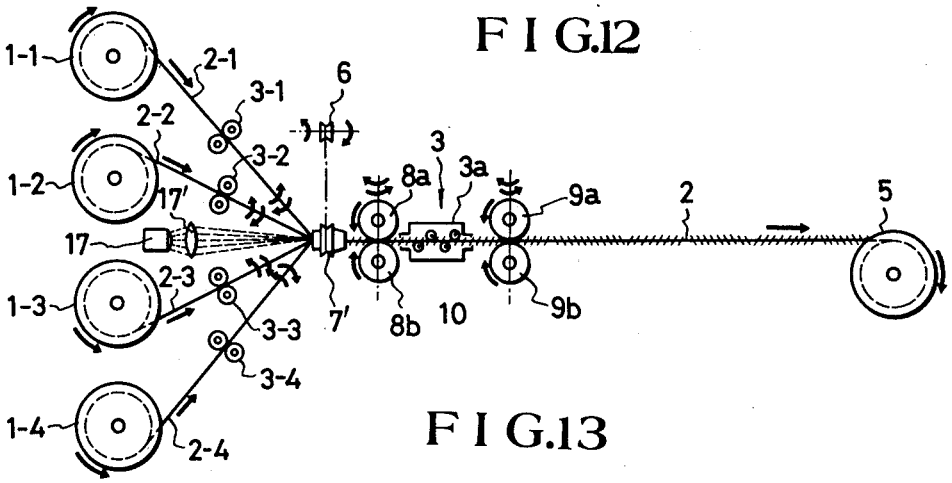
Figure 13:
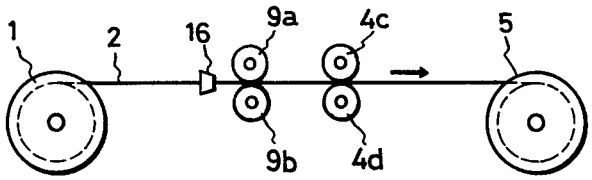
Figure 14:
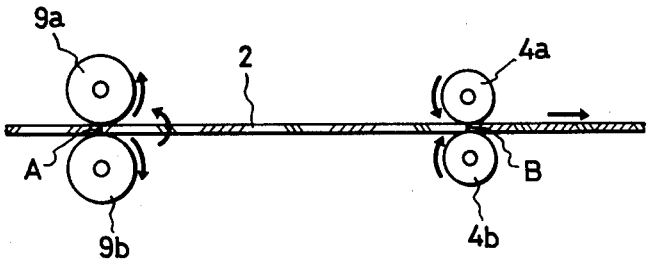

FIGS. 5(*a*) and (*b*) are schematic representation of the system of FIG. 4 for illustrating the operation of the same;

FIGS. 6(*a*) to (*d*) show twisting states of the conductors which is processed by the system in FIG. 4;

FIG. 7 schematically illustrates another embodiment of the conductor twisting system according to the present invention;

FIG. 8 schematically illustrates another embodiment of the present invention;

FIGS. 9(*a*) to (*e*) are twisting states of the conductor for illustrating the process to make a SZ alternately twisted conductor by using the system of FIG. 8;

FIGS. 10 to 12 are schematic illustration of the twisting system for twisting a plurality of the conductors according to the present invention, in which the FIG. 12 system is most preferable;

FIG. 13 is a schematic representation of an improvement of the present invention, in which a vibrator for swinging the running conductor is used, and FIG. 14 is a schematic representation of a modification of the system shown in FIG. 13; and like reference numerals are used to designate like parts and equivalents throughout the drawings of these figures.

Figure 1:
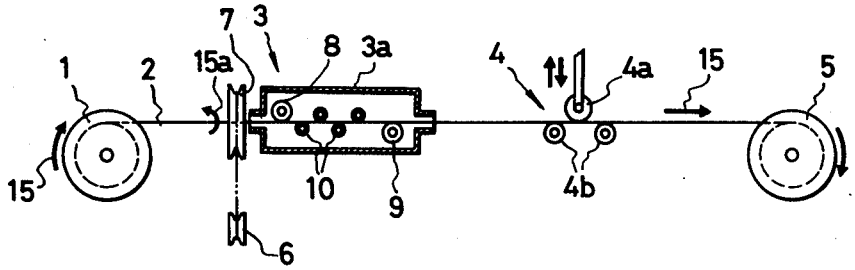
FIG.1 PRIOR ART
FIG. 1 is a schematic representation of a conventional means for production of conventional SZ alternatedly twisted conductor.

Before proceeding with detailed description of the embodiments according to this invention, a short description of my earlier application entitled "SZ Twisting Method of Conductor", Japanese Pat. No. 126078/'73, whose conceptional description previously mentioned, will again be given referring to FIG. 1, for a better understanding of the present invention. Reference is now made to FIG. 1. A wire conductor 2 fed from a feeding reel passes through a stress removing apparatus 3 and a rotation preventive apparatus comprising a pressing roll 4*a* and the lower rolls 4*b*, and finally is taken up by a take-up or winding reel 5. The necessary rotational power transmitted through grooved sheaves 6 and 7 causes a revolving frame 3*a* to rotate in the direction as indicated by an arrow 15*a*. The revolving frame 3*a* is provided therein with guide wheels 8 and 9 for guiding and twisting the running conductor 2 and a group of small rolls 10 for releasing or removing the twisting stress or fixing the twist imparted to the running conductor passing therethrough. The revolving frame revolves in the direction normal to the conductor advancing direction, together with the guide wheels 8 and 9, and the stress removing rolls 10, while the guide wheels 8 and 9, and the rolls 10 are freely rotable in the conductor travelling direction with the travelling of the wire conductor due to the friction between the guide wheels 8 and 9 and the stress removal rolls 10, and the conductor running in contact therewith. With such arrangement, the conductor 2 is twisted clockwise when it enters the revolving frame 3*a*, and continues the travelling thereof through the guide wheels 8 and 9, and the stress removal rolls 10. The rolls 10 disposed between the wheels 8 and 9 act to cause the running conductor to bend alternately in opposite direction applying forces in excess of the elastic limit thereof. Upon the bending action of the rolls 10, the stress in the twisted conductor tending to return it to its original state is released, i.e. the twist of the conductor is fixed. Following this, the conductor with a fixed twist is finally taken up by the take-up reel 5, through the rotation preventive apparatus 4, if operating. Although the conductor taken up is not twisted in appearance, the actual one is a non-twisted conductor with the stress acting to return it to its original state, since the twist fixed conductor is subjected to a twist of opposite direction i.e. counterclockwise twist, in this case. This non-twisted conductor will travel rotating in counterclockwise direction when the end of the conductor is free at the winding reel side. When the rotation preventive apparatus 4 is actuated, i.e. the pressing roll 4*a* is moved downward to press the running conductor against the lower rolls 4*b*, the rotation of the conductor causes the twist of the conductor to completely untwist until the travelling conductor reaches the rotation preventive apparatus 4. Thus, an intermittent operation of the rotation preventive apparatus 4 produces a conductor with a succession of alternation of a twisted portion and a non-twisted portion. The thus formed twisted conductor will be twisted throughout the entire length thereof by the rotational force developed from the clockwise twisted portions.

Briefly, the present invention provides a unique substitution for the conventional revolving frame including the guide wheels 8 and 9, and the stress removal rolls 10, which brings about various problems, as previously noted.

Figure 2:
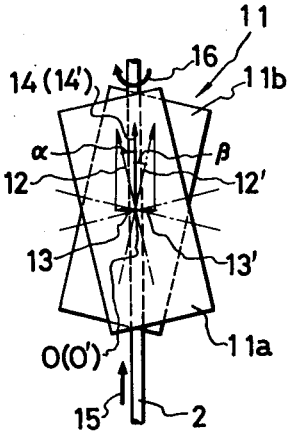
FIG. 2 is a plan view of a set of combined rolls which essential to the present invention.
Figure 3:
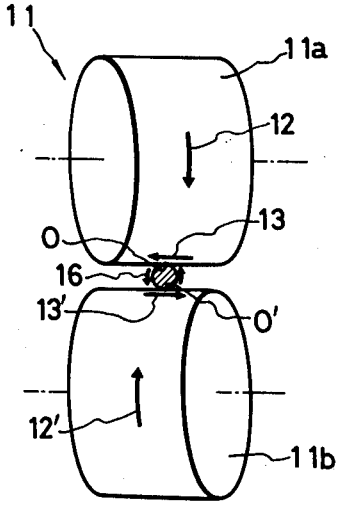
FIG. 3 is a front view of the combined rolls of FIG. 2.

Referring now to FIGS. 2 and 3, there is illustrated a set of combined rolls generally indicated by the reference numeral 11, which are incorporated into a conductor twisting system according to the present invention, as will be referred to later. The roll set 11 is comprised of upper and lower rolls 11*a* 11*b* which are oriented to each other at an angle of $\alpha + \beta$.

In the figures, the reference numeral 2 represents a conductor, and arrow 15 indicates the advancing direction of the conductor 2. The upper and the lower rolls 11a and 11b are identical in surface velocity and in diameter. The arrows 12 and 12′ designate the surface velocities in terms of vectors of the upper and the lower rolls, respectively. The velocity designated by 12 is resolved into two components 13 and 14 of which 14 acts along the advancing direction 15 of the running conductor 2 for advancing the conductor 2, and the other 13 normal to the advancing direction 15 for causing the running conductor to rotate. In like manner, the surface velocity 12′ may be resolved into two components 13′ and 14′. The component 14′ cooperates with the component 14 for advancing the conductor 2, while the component 13′ acts in the direction opposite to that of the component 13 but cooperates with it to rotate the conductor 2.

As stated above, the rolls 11*a* and 11*b* are operated at the same rotational speed. That is, the surface velocities 12 and 12′ are the same. As a result, components of the surface velocity 14 and 14′ are equal in magnitude and are the same in direction at the upper and the corresponding lower side of the running conductor 2. An angle $\alpha$ is formed between the surface velocity 12 of the upper roll 11a and the travelling direction 14 of the wire conductor 2, while an angle $\beta$ is formed between the surface velocity 12′ of the lower roll 11b and the conductor travelling direction 14. The upper and the lower rolls 11*a* and 11*b* are preferably arranged so as to satisfy the requirement of $\alpha = \beta$. Characters 0 and 0′ indicate points of application, i.e. contact points between the upper roll 11*a* and the wire conductor 2, and between the lower roll 11*b* and the same, respectively. It is to be noted here that reference numerals 12, 12′, 13, 13′, 14 and 14′ representing the surface velocity and its components of each of the rolls 11*a* and 11*b*, respectively, also indicate the vector diagram illustrating the force for transferring the wire conductor 2 which is caused by the rotational force of the upper and the lower rolls both of which are rotating in contact with the wire conductor at the contact points 0 and 0′ and the reaction force associated therewith, and the components of the conductor transferring force of which one is in the conductor progressing direction and the other points at right angles to the former component. In particular, when thus combined rolls are rotated in the direction indicated by the arrows 12 and 12′, the components 14 and 14′ of the transmitting forces 12 and 12′ act to cause the conductor 2 to move in the direction of the arrow 15. As shown in the figures, the wire conductor 2 is rotated counterclockwise as indicated by the arrow 16, since the component force 13 normal to the other force 14 draws to the left the upper side of the wire conductor 2 at the contact point 0, while the component force 13′ normal to the other force 14′ pulls to the right the lower side of the conductor 2 at the contact point 0′. As seen from FIG. 2, the following equations hold among Vo (m/min.) indicative of the roll surface velocities 12 and 12′, $V_1$ (m/min.) the conductor transmitting velocity 14 and $V_2$ (m/min.) the velocity normal to the conductor transmitting velocity 14;

$$V_1 = Vo \cos \alpha = Vo \cos \beta$$

$$V_2 = V_2 \sin \alpha \; Vo \sin \beta$$

The rotational speed of the wire conductor N r.p.m. is given $$N = V_2/\pi D = Vo\sin \alpha/\pi D = Vo\sin \beta/\pi D$$

where the diameter of the conductor 2 is D (m).

Assume now that the angles $\alpha$ and $\beta$ are not equal, and that surface velocity 12 of the upper roll 11*a* is different from that 12′ of the lower roll 11*b*. Incidentally, the latter case arises when the diameters of the rolls are different and the rotational speeds are the same, when the diameters thereof are the same but the rotational speeds are different, or when the diameters and the rotational speeds are both different. In such case, the velocity components 13 and 13′ are different in magnitude and thus the conductor rotates at the speed determined by the higher rotational speed. The difference between the surface velocities causes the conductor to move differentially. More precisely, when $V_2$ (m/min.) and $V_2'$ (m/min.) representing the velocity components 13 and 13′, respectively, are different, the wire conductor moves at the speed $V_2$-$V_2'/\pi$ D (m/min.) in the direction of the higher one of the velocity components $V_2$ and $V_2'$, the speed inferring from the equation of the rotational speed N of the wire conductor, i.e. $N = V_2/\pi D = Vo \sin \alpha/\pi D$ (m/min.). With such movement of the conductor wire, the conductor will lose the contact pressure against the rolls so that the rectilinear progression of the conductor in rotation is impossible. Further, in the case of a difference between the angles $\alpha$ and $\beta$ and/or a difference between the surface velocities 12 and 12′, the wire conductor can not advance rectilinearly, even if the velocity components 13 and 13′ are equal in magnitude. This results in problems that it is difficult to smoothly transmit the wire conductor and there arises stress in the conductor. It is to be noted, however, that the combined rolls 11 can operate without any difficulties when the surface velocities 12 and 12′ are equal and the velocity components 13 and 13′ are equal in magnitude but opposite in direction, even if the diameters and the rotational speed of the rolls lla and 11*b* are different.

As seen from the foregoing description, when a pair of rolls are arranged in a proper way, the resultant of the surface velocities 12 and 12′ of the respective rollers 11a and 11b may concurrently provide a rectilinear progression and the rotation of the wire conductor.

It will be appreciated that such combined rolls may be used in place of the guide wheels 8 and 9 for rotating the conductor and for advancing it rectilinearly.

Turning now to FIG. 4, there is shown an embodiment of a conductor twisting system according to the present invention, in which a set of the combined rolls heretofore described are employed instead of the guide rolls 8 and 9 shown in FIG. 1. In FIG. 4, a first set of combined rolls 8*a* and 8*b* is a substitution for the guide wheel 8 and FIG. 1, while a second set of combined rolls 9*a* and 9*b* is a substitution for the guide wheel 9. A revolving frame 3*a* having stress releasing rolls 10 revolves in the rotating direction of the conductor substantially in synchronism with the rotation of the conductor. The revolving power for the revolving frame 3*a* is fed through a pair of sheaves 6 and 7. Reference characters A, B and C indicate contact points with the running conductor 2 of the first and the second sets of combined rolls 8*a* and 8*b*, and 9*a* and 9*b*, and of the rotation preventive apparatus 4 comprising a pressing roll 4*a* and the lower rolls 4*b*. As described above, the revolving frame in FIG. 1 is of a large dimension since it must be provided therein with the guide wheel of a large size. On the other hand, it should be noted that, according to the present invention, the revolving frame 3*a* may be made small, because there is no need for the use of such bulky wheels 8 and 9. The remaining portion of this conductor twisting system is the same as that of the conductor twisting system in FIG. 1.

Reference is now made to FIGS. 5(*a*) and (*b*) illustrating the operation of the conductor twisting system according to the present invention, shown in FIG. 4 when manufacturing an SZ alternately twisted conductor. The conductor twisting system in FIG. 5(*a*) is in a nonoperating condition of the rotation preventive apparatus 4 in which the pressing roll 4a is displaced from the running conductor 2. The first and the second sets of combined rolls 8*a* and 8*b*, and 9*a* and 9*b* rotate in synchronism with each other to transmit the wire conductor 2 from the feeding reel 1 to the take-up reel 5, while at the same time these combined rolls act at the respective points of application A and B to cause the running conductor 2 to rotate at the same rotational speed. The wire conductor running upstream of the point A of application in twisted clockwise as indicated by oblique lines each ascending to the right. With further progression of the conductor 2 the second set of the combined rolls 9*a* and 9*b* partly serves to ensure the clockwise twist of the wire conductor 2 running between the points of application A and B. The stress removing apparatus 3 having the revolving frame 3, the stress removing rolls 10, and sheaves 6 and 7, is located between the points A and B and serves to fix the clockwise twist of the running conductor 2 or release of the stress therein. The revolving frame 3*a* revolves at the same speed and in the same direction as those of the conductor 2, for purpose of ensuring the fixing of twist. One form of the simplest methods for effecting the stress removal of the conductor is to slightly contact a fixedly mounted roll or pin with the running wire conductor. This method is effective when the wire conductor is an annealed copper wire, for example. According to such method, the conductor twisting system may be further simplified in construction and operable a much higher rate of twisted wire production. When the contact pressure between the group of rolls 10 for removing the stress of the conductor and the conductor 2 is excessive, no stress removal action, but rotation preventive action occurs, so that the twist of the conductor will be untwisted to zero until the wire conductor passes the point A to reach the stress removal rolls. Additionally, a newly formed twist, in the wire conductor running from the stress removal rolls to the point B, and its associated stress as well can not be fixed and released. For this, the conductor immediately after passing the second set of the combined rolls 9*a* and 9*b* is untwisted to return to its original form with no twist, thus giving no useful effects resulting from the present invention. A great care must be taken in practical use of the conductor twisting system according to the present invention.

In this manner, the clockwise twist of the conductor when it passes the point A is fixed between the points A and B and then the clockwise twist fixed after passing the point B travels in counterclockwise rotation to be taken up by the take-up reel 5. This clockwise twisted conductor loses in appearance the twist thereof at the take-up point D of the take-up reel 5 due to the existence of the left-handed rotation. However, this conductor in effect has a clockwise twisting stress. Accordingly, the rotational speed distribution from the point B to the point D is such that the rotational speed at a maximum at the point B decreases to be zero at the point D as the conductor advances toward the point D. The following relation holds for the maximum rotational speed N of the conductor, i.e. the rotational speed caused by the action of the first and the second sets of the combined rolls 8a and 8b, and 9a and 9b, and for the rotational speed $N_2$ thereof at the point C.

$$N_2 = N \times \text{Distance between the Points C and D} / \text{Distance between the Points B and D}$$

Figure 5B:
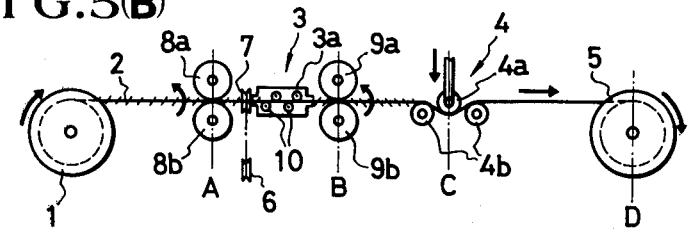

FIG. 5(b) shows an operating condition of the rotation preventive apparatus in the conductor twisting system in FIG. 4. The operation of the conductor twisting system in common in both the condition shown in FIGs. 5(*a*) and (*b*) with the exception that the pressing roll 4*a* presses the running conductor 2 against the lower rolls 4*b* thereby preventing the rotation of the wire conductor passing therethrough. The wire conductor 2 whose clockwise twist is fixed by an operation of the stress removal apparatus 3, experiences counterclockwise rotation which is the same as that of the clockwise twist, when travelling from the points B to C. By maintaining the interval between the points B and C is sufficiently short the clockwise twisted wire formed during running from the points A to B is gradually untwisted to return to its original untwisted state at the point C. Thus, the conductor when it is taken up by the take-up reel 5 is non-twisted. Hence, by maintaining the short interval between the points B and C, the counterclockwise twist of the conductor rotation acts on the running conductor 2 with a force in excess of the elastic limit of the wire conductor thereby producing the unstressed untwisted state of the conductor.

Thus, with an alternate repetition of operation and non-operation of the conductor twisting system (FIGS. 5(*a*) and (*b*)), a twisted portion and a non-twisted portion successively appear in alternation on the wire conductor passing at the point C. A counterclockwise twist is applied to the wire conductor when the rotation preventive apparatus 4 is not operating. As a result, the conductor wire with the successive alternation of the twisted and the non-twisted portions running from the points C to D is twisted counterclockwise one-half of the number of rotations produced by the actions of the first and the second sets of the combined rolls 8*a* and 8*b*, and 9*a* and 9*b*. Therefore, when taken up by the take-up reel 5, the non-twisted portion of the wire conductor is in a counterclockwise twist with the pitch thereof twice of that when the conductor twisting system is in an operating condition shown in FIG. 5(*b*). The pitch of the clockwise twisted portion is the same as that of the counterclockwise twist produced by the rotations of the combined rolls 8*a* and 8*b*, and 9*a* and 9*b*, when the wire conductor runs between the points B and C. However, since the wire conductor running from the points C to D is subjected to a counterclockwise twist with twice the pitch compared with that found between the points B and C, the clockwise twisted portion of the wire conductor at the take-up reel 5 has a doubled pitch compared to that of the clockwise twist given at the initial stage. It will be appreciated thus that the wire conductor at the last stage where it is taken up is an SZ alternately twisted wire conductor with a successive alternation of a left-handed twist portion having a stress acting thereto in opposite direction and a double pitch twisted portion in righthand direction having a stress acting to return it to its fully clockwise twist state.

FIG. 6(*a*) shows the twisting state at every station in the conductor twisting system in FIG. 5(*a*) in which the direction of the twist is indicated by the upward direction of the oblique lines while the pitch of twist is represented by the space between adjacent oblique lines. It can be seen from the figure that the running conductor from the feeding reel to the point A is twisted clockwise with an arbitrary pitch; the direction of the twist and the pitch are sustained during the running of the wire conductor from the points A to B; and the clockwise twist thereof is gradually untwisted to zero in appearance at the point D due to the counterclockwise rotation produced and the rotation preventive action of the take-up reel, when the wire conductor with the clockwise twist runs from the points B to D, through C. In this case, the point C is ineffective because the rotation preventive apparatus is inoperative. As shown in FIG. 6(*b*) depicting the twisting state of the wire conductor at every station in the conductor twisting system of the FIG. 5(*b*), the wire conductor unwound from the feeding reel 1 to the point A of application experiences a clockwise twist which becomes gradually smaller in pitch as the wire conductor advances; the clockwise twist and the pitch thereof are sustained without any change during the running of the wire conductor from the points A to B; the twist is perfectly untwisted by the operation of the twist preventive apparatus when the wire conductor runs from B to C of the points; and finally the non-twisted wire conductor leaves the point C and travels toward the point D. As seen from the figure, there is no difference in the twisting state between FIGS. 6(*a*) and (*b*) on the conductor ranging from the points A to B, but a difference of the twisting state is found on the conductor running from the points B to D. In FIG. 6(*c*), there is shown a twisting state of the wire conductor just following the point C when the rotation preventive apparatus 4 is intermittently operated. There is observed a successive alternation of the twist of the clockwise and no twist on the wire conductor. FIG. 6 (*d*) illustrates a twisting state of the conductor wire at the point D of the take-up reel 5. The wire conductor running in the interval between the point C and D is entirely twisted counterclockwise rotations whose number is equal to that of the right-handed twist. More specifically, the right-handed twist is untwisted to have a doubled pitch, while the non-twisted portion is counterclockwise twisted by the left-handed rotation of stress to have a doubled pitch of the clockwise twist of FIG. 6(*c*).

It will be seen from the foregoing description that the uniquely combined rolls enables the running wire conductor to continuously be twisted and rotated and alternately twisted, when using the conductor twisting system in FIG. 4, for example. It also to be noted that this system may also be applied to the twisting of a plurality of wire conductors, in like manner.

The use of such combined rolls presents the following useful advantages. Production rate of the twisted conductor is made high with small revolving frame the use of which is permitted. The small inertia of the rolls enables a quick operation of the conductor twisting system. Moreover, in the conductor twisting systems of the prior art, bulky guide wheels act to transmit the conductor depending on the contact force thereof with the wire conductor. For this reason, when operating at a high production rate, a strong centrifugal force is developed which is harmful for a fragile wire conductor. That is, such centrifugal force gives an excessive tension to the conductor thereby extending the conductor unnecessary. However, according to the present invention, the combined roll per se has an ability to transmit the conductor so that such over-tension on the conductor is avoidable, if synchronism is established between the rotational speeds of the combined rolls and the take-up reel.

As previously stated, the main feature of the present invention is that the resultant force of the rotational forces of the respective rolls is directly used to transmit the wire conductor. The resultant force also is advantageously used to improve the performance of the conductor twisting system. An example of this system is the wire conductor twisting system in FIG. 4 without the revolving frame 3*a* in which the first combined rolls 8*a* and 8*b* have lower rotational speed than the second combined rolls 9*a* and 9*b*. There are various methods to remove the stress of the wire conductor, for example, a method using bend-curing rolls, a method of heat treatment, a method using coating varnish for fixing the twist, a method using adhesive tape and so forth. An additional method to release the stress of the conductor to be referred to here is the one to provide a minimum amount of extension of the conductor beyond the yield point of the conductor. In the case of an annealed copper wire, this is attained when the conductor is extended by 0.2% of the length, and is subjected to a weight of 13.8 Kg/mm. Thus, the method or system under consideration may be realized by employing a simple arrangement in which the rotational speed of the second set of the combined rolls is 0.2% higher than that of the first set of the combined rolls, or the difference of the rotational speeds between the first and the second sets of combined rolls is established so as to develop tension of more than 13.8 Kg/mm. It is to be noted that the use of such arrangement eliminates the need of the revolving frame 3*a* for removing the stress developed in the running conductor. This method of conductor extension may further be employed together with the revolving casing 3*a*. That is, the rotational speed difference between the first and the second combined rollers is established at such a value as to produce a tension below the yield point of the conductor. In this case, the stress may be released by a slight contact of a fixed pin with the running conductor. When an annealled copper wire, for example, is employed for the running conductor, 10 Kg/mm is the necessary tension for releasing the stress. It should be noted that these methods just mentioned eliminate the need of a relatively bulky and heavy revolving casing often accompanied by troubles, which revolves in the plane normal to the conductor running direction. This fact is very important in the conductor twisting process in which the conductor rotates at very high speed. This is because the centrifugal problems are inevitable in the prior art system with such revolving means, as previously stated, when the running conductor is processed at a high speed of rotation.

This method for releasing the stress in the conductor results in various beneficial effects. That is, an increase of the relational speed of the conductor may be permitted, so far as the centrifugal force developed in the conductor gives no harm to the conductor, since, in this method, the conductor per se rotates. With an elimination of revolving means revolving normal to the conductor progressing direction, vibration and noise produced by the centrifugal force also are eliminated, thus improving safety and working environment. No damage of the wire conductor results from centrifugal force and wind pressure so that the reliability and the quality of the product is remarkably improved. So far as the conductor is enduarable for its inertia, it is possible to transmit the conductor at a high speed, or to bring the conductor to a sudden start or stop. The crossing angle $\alpha+\beta$ (FIG. 2) is widely changeable in a simple manner, unlike the conductor twisting system of prior art using the speed change gear, etc.

Reference will now be made to FIG. 7 illustrating a second embodiment of the conductor twisting system according to the present invention. As readily seen from FIG. 7, this example corresponds to the FIG. 4 system with omission of the first set of combined rolls 8*a* and 8*b*. Thus, the description of the instant example will directly consider the operation thereof without particularly referring to the structure. In operation, the wire conductor 2 unwound from the feeding reel 1 with clockwise twist caused by the rotation of the combined rolls 9*a*, 9*b* enters the revolving frame 3*a* where the clockwise twist is fixed, and further advances through the rolls 9*a* and 9*b* and the rotation preventive apparatus 4 finally to the take-up reel 5. An extruding machine 11 drawn in dotted lines is located just following the stress preventive apparatus 4. This extruding machine 11 was not used in the first embodiment in FIG. 4. It will be readily appreciated, however, that, if necessary, the machine 11 may be easily applied to the example of FIG. 4. The fixedly twisted conductor 2 emanating from the combined rolls 9*a* and 9*b* travels in counterclockwise rotation to the take-up reel 5, if the stress preventive apparatus is not operated, i.e. the depressing roller 4*a* is not pressed down. If the stress preventive apparatus 4 is intermittently operated, the SZ alternately twisted conductor may be obtained, as in the case of FIG. 5. The omission of the stress releasing apparatus 3 may also be possible if the rotational speed of the combined rolls 9*a* and 9*b* with respect to that of the feeding reel 1 is so adjusted as to develop a tension therebetween in excess of the yield point of the conductor. The conductor twisting system in this example enjoys an advantage over that of FIG. 4 in the simplicity of construction but is poorer in precision in comparison with the FIG. 4 system. With the use of the extruding machine 11, the conductor advancing with twist and rotation may be covered with insulating material.

Refering now to FIG. 8, there is shown a third embodiment of the conductor twisting system according to the present invention, in which another pair of rolls 4*c* and 4*d* are employed instead of the rolls 4*a* and 4*b* of the rotation preventive apparatus 4. The rolls 4*c* and 4*d* are used for preventing the rotation of the conductor and are so arranged that the axes of them are parallel to each other. The SZ alternately twisting operation may also be enabled with an intermittent operation of the rolls 4*c* and 4*d*. Further, if the twist is fixed by the tension developed by establishing a proper rotational speed difference between the combined rolls 9*a* and 9*b* and the rotation preventive rolls 4*c* and 4*d*, the SZ alternately twisted conductor obtained is greatly improved in the precision of the pitch of twist. In the case where the first combined rolls 8*a* and 8*b* and the second combined rolls 9*a* and 9*b* are adjusted for clockwise rotation and the third rolls 4*c* and 4*d* are adjusted for counterclockwise rotation, the SZ alternately twisted conductor may be directly obtained, unlike the previous cases, if the third rolls are intermittently operated. This will be described in detail with reference to FIGS. 9(*a*) to (*e*).

In FIG. 9(*a*) illustrating the twisting state of the conductor at every station in the conductor twisting system of FIG. 8 with the combined rolls 4*c* and 4*d*, the wire conductor with clockwise twist to be imparted thereon passes the points A and B where the clockwise twist thereof is fixed, further advances in the interval from the points B to C where the clockwise twist is gradually untwisted as it proceeds, and finally is taken up at the point D where the conductor is perfectly untwisted. FIG. 9(*b*) illustrated the twisting state of the running conductor when the third rolls 4*c* and 4*d* cooperatively act to impart the counterclockwise twist on the running conductor. In the figure, the clockwise twisted conductor passed through the points A and B is untwisted to return to its original shape at the middle point in the interval between the points A and B by the action of the combined rolls 4*c* and 4*d*, and then is gradually twisted in opposite direction as the conductor travels toward the point C, and further continues to travel through the point C to the final point D while the twist in the opposite direction, i.e. the conterclockwise twist of the conductor is gradually untwisted as the conductor progresses. FIG. 9(*c*) and FIG. 9(*d*) illustrate the twisting states of the conductor at the point C; the former corresponds to that when the third rolls 4*c* and 4*d* are not operated, and the latter when the third rolls 4*c* and 4*d* are operated. FIG. 9(*e*) shows the twisting state of the conductor running at the point C when the combined rolls 4*c* and 4*d* intermittently operates. That is, the conductor depicted in the figure is an SZ alternately twisted conductor of a successive alternation of clockwise twist the counterclockwise twist. In the SZ alternately twisted conductor, the clockwise and the counterclockwise rotations are identical in the number thereof, so that such conductor after passing the point C experiences no rotation. Thus, the SZ alternately twisted conductor without any rotation reaches the point D of the take-up reel 5. The conductor twisting system of FIG. 8 may also be modified such that the inter-roll tension in the conductor as it passes between the first and the second sets of rolls 8*a* and 8*b*, and 9*a* and 9*b* is used in place of the revolving frame 3*a* for purpose of simplification of structure and increasing the production rate of the twisted conductor. In this modification the rotation preventive apparatus 4 comprising the pressing roll 4*a* and the lower rolls 4*b* may be used instead of the rolls 4*c* and 4*d*. It is to be noted that the SZ alternately twisted conductor may be manufactured by means of merely two sets of the combined rolls. It will be understood that the angles $\alpha$ and $\beta$ may be quickly changeable by means of a proper simple means well known and the rotational speed thereof may also be changeable in quick and easy fashion. Change of the rotational direction thereof can be done in like manner. More specifically, if the means for controlling the rotational speed, rotational direction and the angles of $\alpha$ and $\beta$ is provided for the conductor twisting system, a single set of combined rolls is sufficient in manufacturing the twisting conductor including the SZ alternately twisted conductor. In other words, a simple and a high speed operational conductor twisting system may be realized without the stress releasing apparatus 3 comprising the revolving frame 3*a*, the plurality of rolls 10, and the revolving power transmitting means of sheaves 7 and 6 but with a single set of combined rolls. This is a most important feature of the present invention.

Finally, the example of FIG. 8 may also be provided with the plastic extruding machine 11 immediately subsequent to the combined rolls 4*c* and 4*d* for covering the twisted conductor with insulating material.

For attaining an effective operation of the combined rolls, the material for the rolls must be selected depending on the various factors, i.e. whether they are used for twisting a single wire conductor or a plurality of conductors, the material of the running wire conductor, and so forth. Metal rolls or hard plastic rolls may be suitable for wire conductors of steel while semi-hard synthetic rubber may be suitable for annealed copper wire and are shiftable with a slight power and susceptible to distortion. Rubber rolls are generally suitable for twisting the wire conductor covered with relatively hard material while a resilient full foamed urethane rubber rolls are suitable for wire conductors covered with soft material. When twisting a plurality of conductors, foamed plastic or foamed rubber is suitable for the rolls, an air-filled soft rubber tube is preferably if necessary, for increasing the contact surfaces of the rolls with the conductor running therebetween thereby to ensure the twist.

In a practical use of the combined rolls, it is necessary to avoid a direct contact of the surface of one roll with the other, otherwise force components in opposite direction produced on the surfaces of the rolls act to damage the surfaces thereof. It is desirable to enlarge the contact surfaces of the rolls with the conductor running therebetween for ensuring the action of the rolls. In designing the, the material and the rolls'pressure of the rolls on the conductor must be determined depending upon the various factors mentioned above.

FIGS. 10 through 12 illustrate embodiments when the present invention is applied to a twisting system for alternately twisting a plurality of conductors in the S and the Z directions. In these figures, wire conductors 2-1, 2-2, 2-3 and 2-4 unwound from the respective feeding reels 1-1, 1-2, 1-3, and 1-4, pass through combined rolls 3-1, 3-2, 3-3 and 3-4, respectively, to enter a rotating die 7' where these conductors are twisted. The rotating die 7' is rotated in the same direction as that of the wire conductors by the rotating power transmitted through V-groove pulley 6. Designated by reference numerals **8*a* and 8*b*, and 9*a* and 9*b* are first and second combined rolls. The stress releasing apparatus 3 is comprised of a revolving frame 3*a* and a plurality of rolls 10. In FIG. 10, the rotation preventive apparatus 4 comprises the pressing roll 4*a* and a pair of rolls 4*b*, as in the previous cases. The rotation preventive apparatus 4 in FIG. 11 comprising combined rolls 4*c* and 4*d* has an additional function to impart inverse twist on the running conductor. It is to be noted that the feeding reels 1-1, 1-2, 1-3 and 1-4** are shown herein as four in number by way of example only, and thus is not limited to this number.

The twisting system for twisting a plurality of conductors in FIG. 12 is arranged such that the directions of the rotational forces of the upper and the lower rolls of each combined roll set are interchangeable with each other, so that the twist or the rotation of the running conductor is simultaneously or intermittently reversed in direction. In the figure, reference numeral 5 is a take-up reel, and 17 and 17' are in infrared light source and a focusing lens, respectively. This optical system comprising the infrared light source 17 and the focusing lens 17' intermittently acts to instantaneously weld the nodal points of the SZ alternately twisted conductors for fixing them.

Turning now to FIG. 10, there is shown an application of the conductor twisting system of FIG. 4 to the twisting system for twisting a plurality of conductors. The construction and the operation of the FIG. 10 twisting system are the same as that of the FIG. 4 twisting system with the exception that four feeding reels 1-1 to 1-4 and four sets of combined rolls 3-1 to 3-4 and the rotating die 7' are additionally provided. As previously stated, when the running conductors 2-1, 2-2, 2-3 and 2-4 are transmitted with tensions each slightly higher than the yielding point of the respective conductors, the tensions being produced in the conductor running between the feeding reels 1-1, 1-2, 1-3, and 1-4 and the combined rolls 3-1, 3-2, 3-3 and 3-4, it is possible to impart the twist and the rotation simultaneously to the running respective wire conductors.

It is known that, in the case of a plurality of rolls rotating in the same direction, a mere combination of such wire conductors automatically rotates due to self-developed stress to twist conductors together. Likewise, when the component conductors 2-1, 2-2, 2-3 and 2-4 each in rotation are combined at the rotating die 7', the combined conductors retate by themselves to form a strand. In this case, it is preferable that the rotating die 7' rotates in synchronism with the rotation of the strand in the same direction. This is because, if not so, the frictional resistance produced between the die and the conductor running therethrough acts to prevent the selftwisting action of the combined wire conductors. In this case, the first combined rolls **8*a* and 8*b* and the stress removal apparatus 3 are unnecessary, since the combined conductors leaving the rotating die 7' rotate by themselves to form a strand of twisted conductors and thus the strand thus formed has no stress acting to untwist the twist of the strand. The second combined rolls 9*a* and 9*b* serve not only to ensure the rotation of the strand but also to aid the action of the rotation preventive apparatus 4 when it operates, thereby to untwist the twist of the strand for forming the non-twisted strand. The stress kept in the untwisted strand acting to restore it to its original state of twisted form is released upon the bending produced when the strand passes the twist preventive apparatus 4 when in an operating condition. Therefore, when the rotation preventive apparatus 4 intermittently operates, the strand emanating from the twist preventive apparatus 4 takes the form of a successive alternation of the twisted and the non-twisted portions, and the strand, when it is taken up the take-up reel 5, takes the form of the SZ alternately twisted strand due to the rotation by the stress in the strand. This process is the same as that found in the conductor twisting system of FIG. 4. The first combined rolls 8*a* and 8*b* and the stress releasing apparatus 3** which can be omitted may also be used for aiding the actions of the respective portions in the embodiment just mentioned.

Further reference will be made to FIG. 10 illustrating an embodiment of the twisting system for twisting a plurality of wire conductors according to the present invention. When the first and the second combined rolls **8*a* and 8*b* and 9*a* and 9*b* are both simultaneously operated, the combined conductors with twist and rotation advances between the first and the second combined rolls. The strand twisted in such manner has a stress acting to untwist the twist of the strand so that the stress releasing apparatus 3 is necessary to remove the stress. In this arrangement, the revolving die 7' serves to prevent the disposition of the respect conductors combined from become disarranged caused by the pressure of the first set of combined rolls 8*a* and 8*b*, and also to aid the rotation of the strand or the combined conductors ascribable to the action of the combined rolls 8*a* and 8*b*. Further, the combined rolls 3-1 to 3-4 may be omitted in this instance since the rotation of the combined conductors causes the respective component conductors to enter in rotation in the revolving die 7'**. However, the use of the these sets of combined rolls is desirable since the combined rolls serves to promote the rotation of the respective component conductors. Thus processed strand emanating from the second combined rolls 9*a* and 9*b* takes the form of the SZ alternately twisted strand, as stated previously. As seen from the foregoing description, the twisting system for twisting a plurality of conductors in FIG. 10 permits the manufacture of two kinds of the SZ alternatively twisted strand. There is a possibility that the thus formed SZ alternately twisted strand may be untwisted to restore to its original form not twisted, ascribable to the stress to be produced thereafter. For preventing the untwisting operation, the optical welding system 17 and 17′ is used to weld the nodal point of the SZ alternately twisted strand where the direction of the twisted of the combined conductors is reversed. In this case, the optical welding system 17 and 17′ must be synchronized with the intermittent operation of rotation preventive apparatus 4. It is preferable that the strength of the welding is established to such an extent that the welded conductors may easily be separated when the twisted strand is practically used.

FIG. 11 shows other embodiment of the strand twisting system according to the present invention which is a modification of the conductor twisting system shown in FIG. 8 with addition of the feeding reels corresponding in number to the conductors to be twisted into a strand and the revolving die for twisting the conductors into a strand. When comparing with the FIG. 10 system the difference is in the use of a pair of rolls 4*c* and 4*d* in place of the pressing roll 4*a* and a pair of lower rolls 4*b*. The operation in which the combined rolls 4*c* and 4*d* directly produce an SZ strand alternately twisted in the S and the Z directions is the same as that of the conductor twisting system shown in FIG. 8. In this example, with a proper establishment of the transmitting speed of the third combined rolls 4*c* and 4*d* with intermittent operation relative to that of the second combined rolls 9*a* and 9*b*, there is provided an inter-roll tension sufficient to remove the stress produced when the twisted strand issuing from the second combined rolls 9*a* and 9*b* is untwisted and additionally twisted in the untwisted direction. As in the previous case of FIG. 10, the revolving die 7′ serves not only to promote the twisting operation of the first combined rolls 8*a* and 8*b* for preparatory formation of a twisted strand but also to ensure a proper disposition of the conductors for obtaining a uniform twisting state of the strand. The fourth set of combined rolls 3-1 to 3-4 also serves to assist the twisting operation of the first set of rolls 8*a* and 8*b*. This embodiment of the strand twisting system permits omission of several components as in the previous case shown in FIG. 10. For example, omission of the fourth combined rolls 3-1 to 3-4 provides no deterioration in the advantageous effects of the present invention. If a proper inter-roll tension in the strand as it passes between the first and the second set of combined rolls 8*a* and 8*b*, and 9*a* and 9*b*, is established by properly selected the transmitting speed difference therebetween, the stress releasing apparatus 3 comprising the revolving frame 3*a* and rolls 10 may be omitted.

As in the FIG. 10 embodiment, another strand twisting method may be performed by using the FIG. 11 arrangement of the strand twisting system. This will be described in detail below. When the component conductors 2-1 to 2-4 on which the fourth set of rolls 3-1 to 3-4 imparts rotations passes through the revolving die 7′, a collection of the respective component conductors rotates by itself with the stress thereof to form a twisted strand. Such case eliminates the need of the stress removal apparatus 3 and brings about another function of the first and second sets of combined rolls 8*a* and 8*b*, and 9*a* and 9*b*. These sets of the combined rolls 8*a* and 8*b*, and 9*a* and 9*b* in this instance are not the one positively acting to twist the running strand. The functions of these sets of rolls are just to assist the self-twisting of the bundle of the conductors into a twisted strand and also to hold the running twisted strand when the rotation preventive apparatus of the combined rolls 4*a* and 4*b* intermittently operates. Accordingly, either of the two sets of combined rolls 8*a* and 8*b*, and 9*a* and 9*b* may be omitted.

FIG. 12 is a most preferable embodiment of the strand twisting system according to the present invention. As previously stated, the combined rolls essential to the present invention are easily controllable for changing the rotational direction and the rotational speed of the conductor passing therethrough. In particular, the rotational speed of the conductor is controlled by just changing the angles of $\alpha$ and $\beta$ (see FIGS. 2 and 3). The rotational direction of the conductor may be instantaneously reversed if the rotational forces 12 and 12′ are simultaneously interchanged with each other by using a suitable means. For this reason, the rotation preventive apparatuses 4 in FIGS. 10 and 11 may be omitted with an arrangement that the combined rolls 3-1 to 3-4, 8*a* and 8*b*, and 9*a* and 9*b* in FIGS. 10 and 11 are intermittently and instantaneously changed in the directions of the rotational forces. This is realized by the FIG. 12 system. As in the cases of FIGS. 10 and 11, various components may be omitted in this instance. For example, the stress releasing system 3 may be omitted if a proper inter-roll tension in established in the running strand passing between the first set of combined rolls 8*a* and 8*b* and the second set of combined rolls 9*a* and 9*b*, by suitably selecting the rotational speed of the rolls 9*a* and 9*b* with respect to that of the rolls 8*a* and 8*b*. Either of these sets of combined rolls 8*a* and 8*b*, and 9*a* and 9*b* may be omitted if a proper pretension in the strand is provided by a suitable means. In case where the first set of combined rolls 8*a* and 8*b* plays a major role, the fourth rolls 3-1 to 3-4 may be omitted, and if not so, it serves just to play a supplementing role. Moreover, if the fourth set of rolls 3-1 to 3-4 play a major role, the collection of conductors rotates by itself with the stress in the conductors thereby the form a twisted strand. Thus, in this case, upon revolving die 7′ reversing its rotational direction in synchronism with reversal of the rotational direction of the combined rolls 3-1 to 3-4 it plays just a supporting role. This instance of the strand twisting system permits omission of the stress removal apparatus 3, the second sets of combined rolls 9*a* and 9*b*, and, if necessary, the first set of combined rolls 8*a* and 8*b* as well which otherwise acts to air the rotation of the strand. As seen from the above description, it will be appreciated that the FIG. 12 strand twisting system may be the simplest one in construction with the highest efficiency in the production of the twisted strand, if the components are properly omitted considering the material of the strand, the pitch of twist, etc.

Referring now to FIG. 13, there is shown another embodiment of the conductor twisting system according to the present invention. In this conductor twisting system, the stress in the running conductor 2 between the feeding reel 1 and the combined rolls 9*a* and 9*b* is released by a tension formed therebetween by properly establishing a pretension imparted to the running conductor by the feeding reel 1 and by suitably selecting the rotational speed of the combined rolls 9*a* and 9*b*. As in the case in FIG. 8, the rotation preventive apparatus 4 is comprised of a pair or rolls 4*c* and 4*d* whose axes are aligned in parallel each other. Designated by the reference numeral 16 is a vibrator for swinging the running conductor in both the directions normal to the conductor advancing direction. More particularly, the running conductor 2 cyclically shifts by the points of application 0 and 0'. That is, the running conductor 2 is intermittently twisted. The twisting state of the running conductor formed by this conductor twisting system is illustrated in FIG. 14. As shown in the figure, the conductor 2 travels between the combined rolls 9*a* and 9*b* where the conductor is simultaneously subjected to an intermittent clockwise twist and fixing of the twist. Accordingly, the conductor leaving the combined rolls 9*a* and 9*b* advances in counterclockwise rotation and with a series of clockwise fixed twist portions, and then enters the combined rolls 4*a* and 4*b* whose axes are aligned in parallel so as to provide solely a transmission force of the conductor passing therethrough, i.e. without the rotational force for rotating the running conductor 2, as stated previously. The rotation preventive action of the combined rolls 4*a* and 4*b*, as in the previous case, serves to apply a twist in the direction opposite to that of the twist which is imparted to the conductor and fixed at the preceding stage, to the running conductor in its entire length ranging from the first combined rolls 9*a* and 9*b* to the second combined rolls 4*a* and 4*b*. As a result, the non-twisted portion of the running conductor is twisted by the twist or the rotational force given by the rotational preventive rolls 4*a* and 4*b* in the direction of the rotational force, while the twisted portion thereof is untwisted by the same. Accordingly, the conductor emanating from the second rolls 4*a* and 4*b* takes the form of a series of twisted portions alternately twisted in the S and Z directions. The number of rotations of the conductor running from the first combined rolls 9*a* and 9*b* to the second rolls 4*a* and 4*b* is the same as that of the twist which is intermittently imparted and fixed at the first combined rolls 9*a* and 9*b*. Thus, if the intermittent twist formed at the first combined rolls 9*a* and 9*b* is precisely controlled in the length of each longitudinal section of the conductor 2, a precise SZ alternately twisted conductor may be produced.

While, in the instance of FIG. 14, a set of combined rolls has been used as the rotation preventive apparatus, such rotation of the wire conductor may be prevented by using a V-grooved guide wheel, a drum for taking up the conductor, or the like. The combined rolls, however, are preferable since the combined rolls may be easily and precisely controllable in operation.

Many advantageous effects results from this instance of the conductor twisting system as follows: First is that the production rate of the twisting conductor is high, since, unlike the previous cases using the rotation preventive apparatus or the combined rolls for applying an intermittent twist to the running conductor, the rotation preventive apparatus is made small in size. Second is that this conductor twisting system can quickly and precisely follow up a quick change of the running speed of the conductor, since the construction thereof is small and simple. Third is that a high quality of the product of the twisted conductor is secured because of the lack of need of repetitious application of bending to the conductor.

It is to be noted that this vibrator may be applied to those embodiments according to the present invention heretofore described and, if so, many useful effects may be attained, as just described.

With respect to vibration of the running conductor, the running conductor is generally vibrated by a vibrator 16 mechanically or electrically regulated or by the natural vibration of the running conductor incidental to the running of the conductor. It is possible, moreover, to vibrate the combined rolls per se instead of the running conductor.

The conductor or strand twisting system described heretofore is appropriate for twisting conductors with a relatively low tensile strength such as an annealed conductor. On the other hand, in the case of wire conductors with a high tensile strength and a relatively low twisting stress, there is no need of driving the combined rolls. That is, the combined rolls are rotated by the running conductor by reason of friction between the combined rolls and the running conductor. In this case, with the angle between the rotational direction of the each roll and the conductor advancing direction, the friction force causing rotation of the combined rolls is partly transformed into the rotational or the twisting force for the running conductor.

When obtaining a fixed pitch of twist for a conductor or a strand by using the combined rolls, the efficiency of twisting and stranding enhances with diminution of the conductor diameter. For this, reason the crossing angle $\alpha + \beta$ of the combined rolls (FIGS. 2 and 3) may be made small if a conductor with a small diameter is twisted. This also is true for a twisting or a stranding rate for a fixed time. Thus, if the present invention is used for twisting or stranding a conductor with a very small diameter with a relatively large twisting or stranding pitch, the crossing angle of $\alpha + \beta$ is very small. In such case, the crossing angle $\alpha + \beta$ is almost zero, i.e. both the axes of the combined rolls are aligned substantially in parallel, so that a control operation of machining is impossible. On the other hand, when a cable with a relatively large diameter is twisted with a relatively small pitch, the crossing angle of $\alpha + \beta$ is very large, with the result that the efficiency of twisting and strength is excellent, while the transmitting efficiency of the running conductor is deteriorated or the running speed of the conductor is unstable. Such rare case is satisfied with an arrangement in which the respective rolls are parallel with the axes thereof, i.e. the crossing angle of $\alpha + \beta$ is established at zero. However, it will introduce a problem that the component force normal to the conductor transmitting direction is reduced to zero, and thus the rotation of the running conductor is impossible. For avoiding such problem, an arrangement is employed in which the respective rolls are arranged in a parallel fashion and are reciprocably moved relative to each other in the direction of the roll axis. In other words, with reciprocal relative displacements of the rolls along the axes thereof, the conductor running therethrough is at the points of contact subjected to forces in opposite direction but equal in magnitude and normal to the conductor transmitting direction, so that the running conductor is rotated in the direction indicated by the arrow.

Many modifications of the disclosed embodiments will be apparent to those skilled in the art for practicing the advantages of the invention which is defined by the appended claims.

What is claimed is:

1. A conductor twisting system for twisting a running wire conductor comprising at least one set of a pair of rolls having axes of rotation which are inclined at an angle relative to one another and are spaced to permit a rectilinear passage therebetween of a conductor and acting to advance said conductor longitudinally while rotating the same to produce a twist therein, and means including a revolving frame around the conductor and longitudinally spaced from said rolls for fixing the twist imparted to the running conductor before the conductor becomes untwisted by the action of the twisting stress produced therein.

2. A system according to claim 1 wherein said frame has a diameter which is substantially smaller than the combined diameters of the pair of rolls.

3. A system according to claim 1 further comprising means for preventing rotation of the conductor whose twist has been fixed by the twist fixing means.

4. A system according to claim 1 further comprising means for covering the conductor with insulating material after passage thereof through said rolls and the twist fixing means.

5. A system according to claim 1 in which said twist fixing means is immediately downstream of said rolls.

6. A system according to claim 1 comprising a second set of rolls, the twist fixing means being disposed between the first and second sets of rolls.

7. A system according to claim 1 in which the twist fixing means further comprises a plurality of further rolls in said revolving frame for contacting the conductor to remove stress therein, and means for transmitting revolving power to said revolving frame.

8. A system according to claim 7 in which said revolving frame revolves substantially in synchronism with the rotation of the conductor.

9. A system according to claim 1 further comprising a feeding reel for supplying the conductor, the rotational speed of the rolls being higher than that of the feeding reel by a value which produces a tension in the conductor between said feeding reel and said rolls sufficiently high in magnitude to release the stress produced in the wire conductor.

10. A system according to claim 6 wherein the rotational speed of said second set of rolls is higher than that of said first set of rolls by a value which produces a tension in the conductor between said first and said second rolls sufficiently high in magnitude to release the stress produced in the wire conductor.

11. A system according to claim 10 further comprising a third set of rolls having axes parallel to one another for preventing rotation of the wire conductor.

12. A system according to claim 11 in which said third set of rolls rotates at a higher speed than said second set of rolls.

13. A system according to claim 10 further comprising a third set of rolls having reversed angular disposition relative to the rolls of said first and second sets.

14. A system according to claim 1 wherein said angle between the axes of said respective rolls is adjustable.

15. A system according to claim 1 further comprising a plurality of feeding reels each of supplying a conductor to be twisted together into a strand, a revolving die for collecting the conductors fed from said feeding reels, said die feeding the collected conductors to said rolls.

16. A system according to claim 15 further comprising an optical welding system for welding nodal points of SZ alternately twisted strand where the direction of the combined conductors is reversed.

17. A system according to claim 1 further comprising vibrating means for vibrating the conductor so as to be subjected to an intermittent twist.

18. A wire conductor twisting apparatus comprising a feed reel for a wire conductor, a take-up reel for said conductor, a pair of rolls disposed between the reels for imparting twist to the wire conductor passing there through, said rolls rotating in opposite direction with the same peripheral velocity along axes forming an angle therebetween to permit rectilinear passage of the wire conductor therebetween in rotation, a stress releasing means disposed downstream of the feed reel and upstream of said rolls for releasing internal stress developed in the wire conductor fed from the feed reel, a revolving means for revolving said stress releasing means in the same direction and speed as the wire conductor, and a rotation arrestor disposed downstream of said rolls for arresting the rotation of the wire conductor, said arrestor being intermittently operable.

19. An apparatus according to claim 18, further comprising a second set of said rolls disposed upstream of said stress releasing means.

20. An apparatus according to claim 18, in which said rotation arrestor comprises a pair of rollers rotatable about parallel horizontal axes and vertically aligned.

21. A wire conductor twisting apparatus, comprising a feed reel for a wire conductor, a take-up reel for said conductor, first and second pairs of rolls disposed between said reels for imparting twist to the wire conductor passing therethrough, the rolls in each pair rotating in opposite direction at the same peripheral velocity along axes of rotation forming an angle therebetween to permit rectilinear passage of the wire conductor therebetween in rotation, the angle between the axes of said rolls of said pairs, the rotational speed of said rolls and the rotational direction thereof being adjustable stress releasing means disposed between said first and said second pairs of rolls for releasing the internal stress accumulated in the wire conductor fed from the feed reel and a revolving means for revolving said stress releasing means in the same direction and speed as the wire conductor.

22. An apparatus according to claim 21, comprising a revolving ring for collecting a plurality of wire conductors into a strand, said ring being disposed between said feed reel and said first pair of rolls.

23. A wire conductor twisting apparatus, comprising a feed reel, a take-up reel for said conductor, a pair of rolls disposed between the reels for imparting twist to the wire conductor passing therethrough, said rolls rotating in opposite direction with the same peripheral velocity along axes forming an angle therebetween to permit rectilinear passage of the wire conductor therebetween in rotation, a rotation arrestor disposed downstream of said pair of rolls for arresting the rotation of the running wire conductor, said arrester being intermittently operable, and a swinging means for swinging the running wire conductor to the right or to the left so that is is subjected to an intermittent twist, said swinging means being disposed upstream of said pair of rolls.

* * * * *